US010459362B2

(12) United States Patent
Takagami et al.

(10) Patent No.: US 10,459,362 B2
(45) Date of Patent: Oct. 29, 2019

(54) IMAGE FORMING APPARATUS HAVING A VOLTAGE SETTER FOR SETTING THE PROPER INTER-PEAK VOLTAGE VALUE

(71) Applicant: KYOCERA Document Solutions Inc., Osaka-shi (JP)

(72) Inventors: Ai Takagami, Osaka (JP); Satoshi Sunayama, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 16/199,512

(22) Filed: Nov. 26, 2018

(65) Prior Publication Data

US 2019/0163084 A1 May 30, 2019

(30) Foreign Application Priority Data

Nov. 29, 2017 (JP) ..... 2017-228975

(51) Int. Cl.
*G03G 15/20* (2006.01)
*G03G 15/02* (2006.01)
(Continued)

(52) U.S. Cl.
CPC ..... *G03G 15/0225* (2013.01); *G03G 5/08214* (2013.01); *G03G 15/0266* (2013.01);
(Continued)

(58) Field of Classification Search
CPC ..... G03G 15/0225; G03G 15/0233; G03G 15/0266; G03G 15/065; G03G 15/5037;
(Continued)

(56) References Cited

U.S. PATENT DOCUMENTS 4,974,026 A * 11/1990 Maruyama ..... G03G 15/0266 399/222
5,179,397 A * 1/1993 Ohzeki ..... G03G 15/1675 347/140
(Continued)

FOREIGN PATENT DOCUMENTS

JP 2007-199094 8/2007
JP 2010210994 A * 9/2010

*Primary Examiner* — Francis C Gray
(74) *Attorney, Agent, or Firm* — Gerald E. Hespos; Michael J. Porco; Matthew T. Hespos

(57) ABSTRACT

An image forming apparatus includes a photoconductor, a charging member, a voltage applier, a storage unit, a current detector, a characteristic deriver and a voltage setter. The storage unit stores in advance relationship information representing a relationship between an electrical characteristic of discharge products adhering to the surface and a proper inter-peak voltage value capable of properly charging the surface. The current detector detects a current value of a current flowing from the charging member to the photoconductor. The characteristic deriver derives the electrical characteristic of the discharge products adhering to the surface on the basis of an oscillating voltage applied to the charging member by the voltage applier and the current value. The voltage setter sets the proper inter-peak voltage value corresponding to the electrical characteristic derived by the characteristic deriver in the relationship information as the inter-peak voltage value of the alternating-current voltage.

7 Claims, 8 Drawing Sheets

(51) Int. Cl.

| | |
|---|---|
| ***G03G 15/00*** | (2006.01) |
| ***G03G 5/082*** | (2006.01) |
| *G03G 21/00* | (2006.01) |
| *G03G 15/06* | (2006.01) |

(52) U.S. Cl.
CPC ..... *G03G 15/5037* (2013.01); *G03G 15/0233* (2013.01); *G03G 15/065* (2013.01); *G03G 21/0011* (2013.01)

(58) Field of Classification Search
CPC ..... G03G 21/0011; G03G 5/08214; G03G 5/08221
See application file for complete search history.

(56) References Cited

U.S. PATENT DOCUMENTS

| | | | | |
|---|---|---|---|---|
| 2004/0110077 | A1* | 6/2004 | Yachi | C09C 1/3081 430/108.6 |
| 2008/0118289 | A1* | 5/2008 | Sato | G03G 21/0058 399/357 |
| 2017/0285509 | A1* | 10/2017 | Takagami | G03G 15/0266 |
| 2019/0163107 | A1* | 5/2019 | Takagami | G03G 21/0094 |

* cited by examiner

FIG.8

| USAGE STATUS | AIR ENVIRONMENT | | RELATIONSHIP INFORMATION G |
|---|---|---|---|
| | TEMPERATURE T | HUMIDITY H | |
| C1～C2 | T1～T2 | H1～H2 | G11 |
| | | H2～H3 | G12 |
| | | H3～H4 | G13 |
| | T2～T3 | H1～H2 | G14 |
| | | H2～H3 | G15 |
| | | H3～H4 | G16 |
| | ... | ... | ... |
| C2～C3 | T1～T2 | H1～H2 | G21 |
| | | H2～H3 | G22 |
| | | H3～H4 | G23 |
| | T2～T3 | H1～H2 | G24 |
| | | H2～H3 | G25 |
| | | H3～H4 | G26 |
| | ... | ... | ... |
| ... | ... | ... | ... |

IMAGE FORMING APPARATUS HAVING A VOLTAGE SETTER FOR SETTING THE PROPER INTER-PEAK VOLTAGE VALUE

INCORPORATION BY REFERENCE

This application is based on Japanese Patent Application No. 2017-228975 filed with the Japan Patent Office on Nov. 29, 2017, the contents of which are hereby incorporated by reference.

BACKGROUND

The present disclosure relates to an image forming apparatus for charging a surface of a photoconductor.

Conventionally, a photoconductor including a photoconductive layer having a thickness of ten to several tens of μm and forming a surface for carrying electrostatic latent images is used in an image forming apparatus such as a printer or a copier. In an image forming apparatus using such the photoconductor, a phenomenon called image deletion may occur. The image deletion is a phenomenon in which an image is blurred or the periphery of an image is bled.

The image deletion occurs due to a reduction of surface resistance of the surface of the photoconductor. Specifically, by discharge from a conductive member, discharge products such as nitrate ions and ammonium ions adhere to the surface of the photoconductor. If these discharge products absorb moisture in the air to be ionized, the surface resistance of the photoconductor decreases. Electrostatic latent images formed on the surface of the photoconductor having a reduced surface resistance flow to the periphery to induce a potential drop. In this way, boundaries of the electrostatic latent images become unclear, resulting in the image deletion.

Further, in recent years, a surface of a photoconductor of a corotron or scorotron type has been charged using a charging member such as a charging roller arranged in contact with or in proximity to the surface of the photoconductor to reduce an ozone generation amount instead of a charging member such as a corotron or a scorotron arranged out of contact with the surface of the photoconductor. Thus, in recent years, a surface of a photoconductor has received discharge from a closer position and has been more easily worn and deteriorated. As a result, discharge products more easily adhere and the image depletion more easily occurs.

Accordingly, in recent years, there has been proposed a method for accurately setting an inter-peak voltage value of an alternating-current voltage applied to a charging member to charge a photoconductor to a suitable voltage value regardless of the aged deterioration of the photoconductor, the charging member and the like and a variation of an air environment around the photoconductor such as a humidity.

Specifically, a quadratic curve representing a relationship between the inter-peak voltage value and a current value of a current flowing from the charging member to the photoconductor is first determined. Then, two different low-pressure side inter-peak voltage values supposed to be on a lower pressure side than a voltage value of an inflexion point appearing when an inter-peak voltage is boosted in this quadratic curve are obtained. Then, a straight line passing through current values when alternating-current voltages having the obtained two low-pressure side inter-peak voltage values are applied is derived. Then, a high-pressure side inter-peak voltage value supposed to be on a higher pressure side than the voltage value at the inflexion point in the quadratic curve is obtained. Then, a straight line passing through a current value when an alternating-current voltage having the high-pressure side inter-peak voltage value is applied and parallel to a coordinate axis representing the inter-peak voltage value is derived. Thereafter, an inter-peak voltage value corresponding to an intersection of the above two derived straight lines is set as a proper inter-peak voltage value.

SUMMARY

An image forming apparatus according to the present disclosure includes a photoconductor, a charging member, a voltage applier, a storage unit, a current detector, a characteristic deriver and a voltage setter. The photoconductor has a photoconductive layer forming a surface for carrying an electrostatic latent image. The charging member is arranged in contact with or in proximity to the surface. The voltage applier charges the surface by applying an oscillating voltage obtained by superimposing a direct-current voltage and an alternating-current voltage to the charging member. The storage unit stores in advance relationship information representing a relationship between an electrical characteristic of discharge products adhering to the surface and a proper inter-peak voltage value which is an inter-peak voltage value of the alternating-current voltage capable of properly charging the surface. The current detector detects a current value of a current flowing from the charging member to the photoconductor. The characteristic deriver derives the electrical characteristic of the discharge products adhering to the surface on the basis of the oscillating voltage applied to the charging member by the voltage applier and the current value. The voltage setter sets the proper inter-peak voltage value corresponding to the electrical characteristic derived by the characteristic deriver in the relationship information as the inter-peak voltage value of the alternating-current voltage.

BRIEF DESCRIPTION OF THE DRAWINGS

FIG. 8 is a table showing an example of the relationship information stored in a storage unit.

DETAILED DESCRIPTION

First Embodiment

Figure 1:
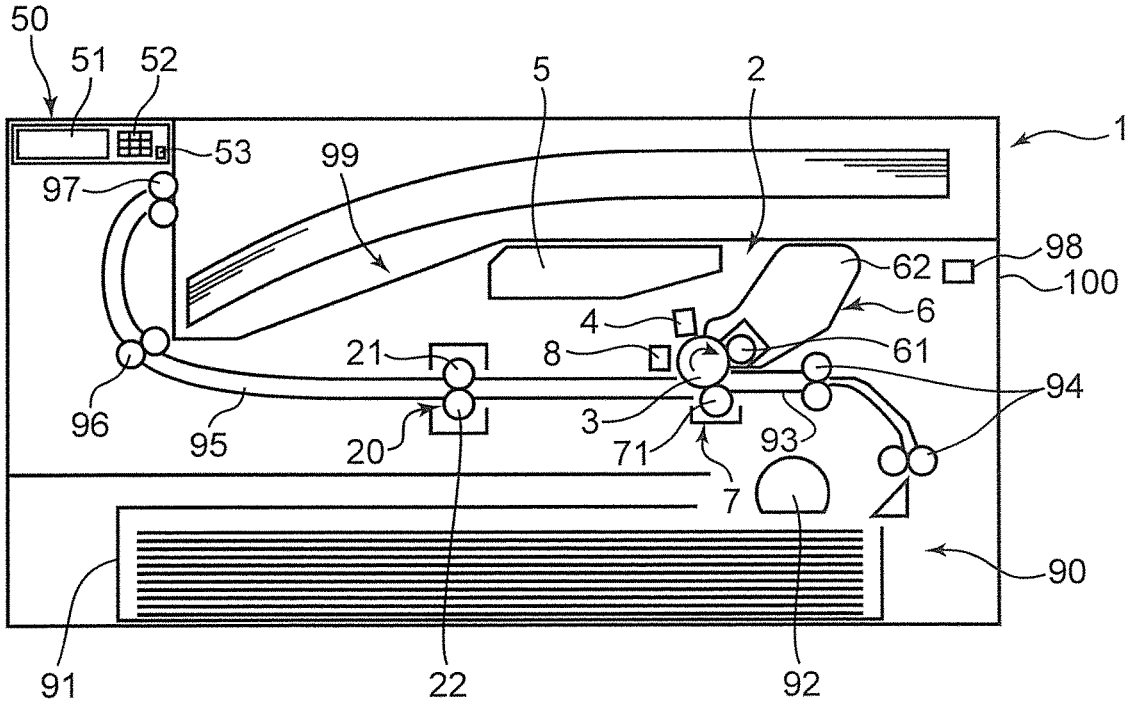
FIG. 1 is a schematic configuration diagram of a printer according to one embodiment of an image forming apparatus of the present disclosure.

Hereinafter, an image forming apparatus according to one embodiment of the present disclosure is described. FIG. 1 is a schematic configuration diagram of a printer 1 according to one embodiment of the image forming apparatus of the present disclosure. As shown in FIG. 1, the printer 1 includes an image forming unit 2, a sheet feeding unit 90, a fixing unit 20, a sheet discharge tray 99, an environment sensor 98 (environment detector) and an operation unit 50.

Figure 2:
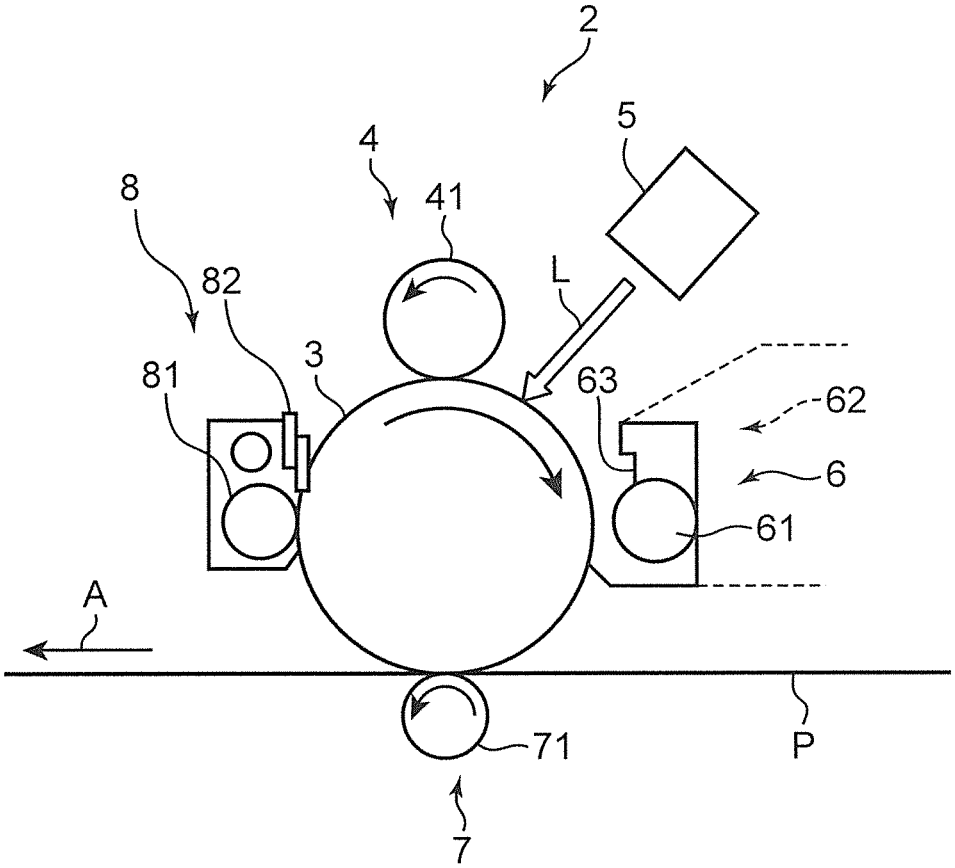
FIG. 2 is a partial enlarged view schematically showing an image forming unit.

The image forming unit 2 forms images on sheets. FIG. 2 is a partial enlarged view schematically showing the image forming unit 2. As shown in FIG. 2, the image forming unit 2 includes a photoconductive drum 3 (photoconductor) and a charging device 4, an exposure device 5, a developing device 6, a transfer device 7 and a cleaning device 8 disposed around the photoconductive drum 3.

The photoconductive drum 3 is a cylindrical body supported rotatably in a predetermined direction (e.g. clockwise direction in FIG. 2). The photoconductive drum 3 includes a photoconductive layer, for example, made of amorphous silicon and having a thickness of ten to several tens of μm. The photoconductive layer forms a surface for carrying electrostatic latent images and toner images corresponding to the electrostatic latent images. Note that the photoconductive layer may be made of selenium arsenic, an organic compound or the like without limitation to amorphous silicon.

The charging device 4 includes a charging roller 41 (charging member) arranged to face in contact with a surface of the photoconductive drum 3. The charging roller 41 imparts electric charges to the photoconductive drum 3 while rotating, following the rotation of the photoconductive drum 3, with a surface thereof held in contact with the surface of the photoconductive drum 3. In this way, the charging device 4 uniformly charges the surface of the photoconductive drum 3 relatively moving with respect to the charging roller 41.

The exposure device 5 includes an unillustrated laser diode for emitting a laser beam. The exposure device 5 irradiates a laser beam L output from the laser diode to the surface of the photoconductive drum 3 uniformly charged by the charging device 4 on the basis of image data stored in a storage unit 140 to be described later. In this way, the exposure device 5 forms electrostatic latent images on the surface of the photoconductive drum 3.

The developing device 6 includes a developing roller 61, a toner storage 62 and a restricting blade 63. The developing roller 61 is arranged to face the photoconductive drum 3 without contacting the photoconductive drum 3. The toner storage 62 stores toner. The restricting blade 63 restricts the amount of toner supplied from the toner storage 62 to the developing roller 61 to a proper amount. The restricting blade 63 restricts a layer thickness of the toner by cutting bristles of the toner adhering in a so-called magnetic brush state to the surface of the developing roller 61. The developing device 6 supplies the toner adhering to the surface of the developing roller 61 onto the electrostatic latent images formed on the surface of the photoconductive drum 3. In this way, the developing device 6 develops the electrostatic latent images into toner images.

The transfer device 7 includes a transfer roller 71 arranged to face the photoconductive drum 3. The transfer device 7 transfers the toner image developed on the surface of the photoconductive drum 3 onto a sheet P in a state where the sheet P being conveyed in a direction indicated by an arrow A is pressed against the photoconductive drum 3 by the transfer roller 71.

The cleaning device 8 includes a cleaning roller 81 and a cleaning blade 82 arranged in contact with the surface of the photoconductive drum 3. The cleaning roller 81 is supported rotatably in the same direction as the photoconductive drum 3. The cleaning roller 81 mechanically removes the toner remaining on the surface of the photoconductive drum 3 after the transfer by the transfer device 7 by rotating at a rotation speed faster than the photoconductive drum 3. The cleaning blade 82 mechanically removes the toner remaining on the surface of the photoconductive drum 3 by an end part in contact with the surface of the photoconductive drum 3.

The cleaning roller 81 further rubs the surface of the photoconductive drum 3 for a predetermined time, using toner containing polishing agent supplied to the cleaning roller 81 under a control of a control unit 10 to be described later. In this way, the cleaning roller 81 polishes the surface of the photoconductive drum 3.

Referring back to FIG. 1, the sheet feeding unit 90 includes a sheet cassette 91 for storing sheets, a pickup roller 92 for picking up the stored sheet, a conveyance path 93 constituting a route along which the sheet is conveyed, and conveyor rollers 94 for conveying the sheet in the conveyance path 93. The sheet feeding unit 90 feeds the sheets stored in the sheet cassette 91 one by one by the pickup roller 92. The sheet feeding unit 90 conveys the fed sheet toward a nip portion between the transfer roller 71 and the photoconductive drum 3 by the conveyor rollers 94 and conveys the sheet having a toner image transferred thereto to the fixing unit 20 via a conveyance path 95. The sheet feeding unit 90 discharges the sheet having a fixing process to be described later applied thereto in the fixing unit 20 to the sheet discharge tray 99 by conveyor rollers 96 and discharge rollers 97.

The fixing unit 20 includes a heat roller 21 and a pressure roller 22. The fixing unit 20 fixes the toner image on the sheet by melting the toner on the sheet by heat of the heat roller 21 and applying a pressure by the pressure roller 22.

The environment sensor 98 detects an air environment around the photoconductive drum 3 and outputs a detection signal indicating the detected air environment to the control unit 10 to be described later. The air environment detected by the environment sensor 98 includes, for example, air temperature and humidity around the photoconductive drum 3.

The operation unit 50 includes a display unit 51 for displaying information, an operation key unit 52 used by a user to give various operational instructions, and a speaker 53. The display unit 51 is, for example, composed of a liquid crystal display having a touch panel function and the like, and displays various pieces of information. The operation key unit 52 includes various keys such as a start key used by the user to input a print instruction and a numeric keypad used to input the number of sets to be printed and the like. The speaker 53 outputs a predetermined sound in accordance with an instruction input from the control unit 10 to be described later.

Figure 3:
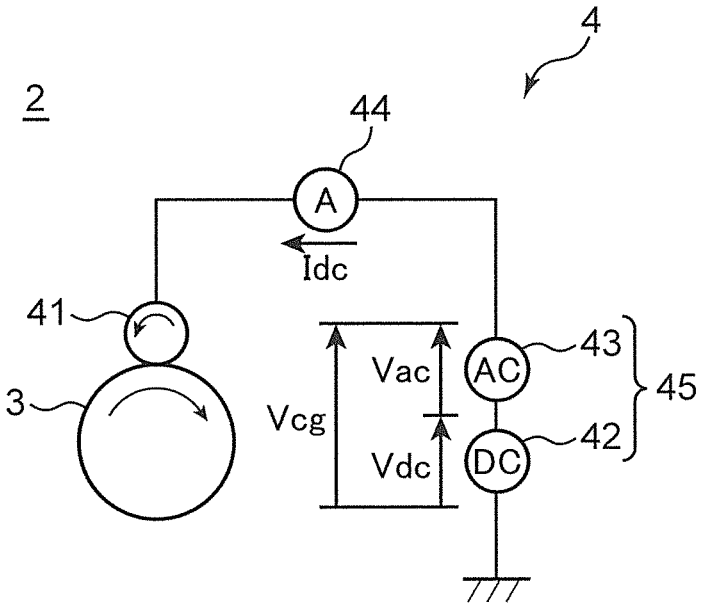
FIG. 3 is a partial enlarged view schematically showing the configuration of a charging device.

Next, the configuration of the charging device 4 is described in detail. FIG. 3 is a partial enlarged view schematically showing the configuration of the charging device 4. As shown in FIG. 3, the charging device 4 includes a charging roller 41, a voltage applier 45 and a current detector 44. The voltage applier 45 includes a direct-current voltage applier 42 and an alternating-current voltage applier 43.

The direct-current voltage applier 42 converts a power supply voltage supplied from an external power supply such as a commercial power supply into a direct-current voltage Vdc having an instructed direct-current voltage value and outputs the direct-current voltage Vdc under a control of the control unit 10 to be described later. The alternating-current voltage applier 43 converts the power supply voltage supplied from the external power supply such as a commercial power supply into an alternating-current voltage Vac having an instructed inter-peak voltage value and outputs the alternating-current voltage Vac under a control of the control unit 10 to be described later. The current detector 44 detects a current value of a charging current (current) Idc flowing from the charging roller 41 to the photoconductive drum 3 and outputs a detection signal indicating a current value of the detected charging current Idc to the control unit 10 to be described later. The current detector 44 is, for example, composed of a current sensor using a Hall element, a shunt resistor and the like.

As shown in FIG. 3, in the charging device 4, a series circuit including the direct-current voltage applier 42 and the alternating-current voltage applier 43 is connected to the charging roller 41 via the current detector 44. Thus, a charging voltage Vcg (oscillating voltage) obtained by superimposing the direct-current voltage Vdc output from the direct-current voltage applier 42 and the alternating-current voltage Vac output from the alternating-current voltage applier 43 is applied to the charging roller 41.

In other words, the voltage applier 45 applies the voltage Vcg obtained by superimposing the direct-current voltage Vdc and the alternating-current voltage Vac to the charging roller 41. The current detector 44 detects the current value of the charging current Idc supplied to the charging roller 41 from the direct-current voltage applier 42 and the alternating-current voltage applier 43, i.e. the current value of the charging current Idc flowing from the charging roller 41 to the photoconductive drum 3 with the charging voltage Vcg applied to the surface of the photoconductive drum 3.

Figure 4:
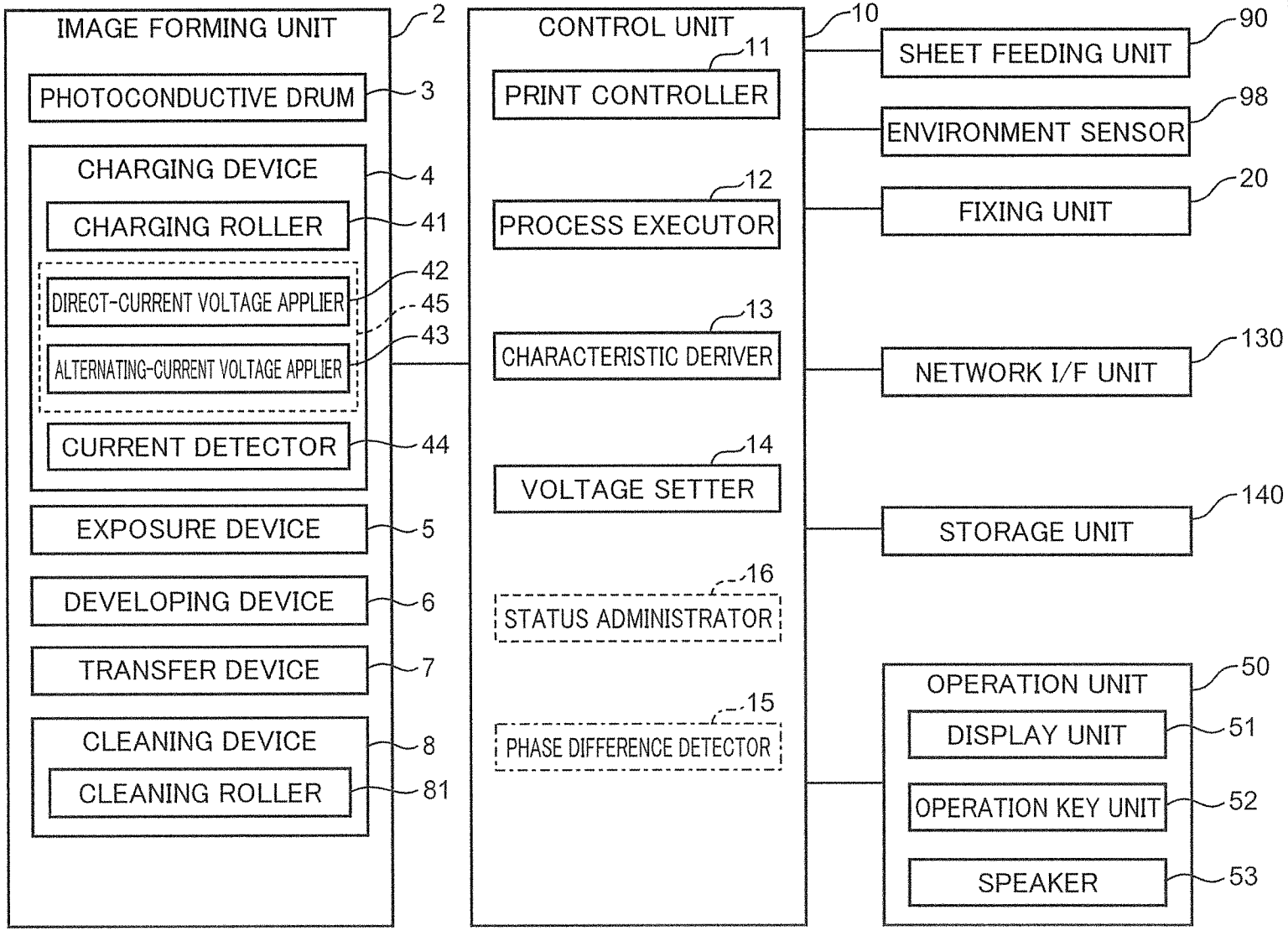
FIG. 4 is a block diagram showing the electrical configuration of the printer.

FIG. 4 is a block diagram showing the electrical configuration of the printer 1. As shown in FIG. 4, the printer 1 includes the image forming unit 2, the sheet feeding unit 90, the environment sensor 98, the fixing unit 20, a network I/F (interface) unit 130, the storage unit 140, the operation unit 50 and the control unit 10.

The network IF unit 130 is connected to a network such as a LAN (Local Area Network). The network IF unit 130 is a communication interface circuit for controlling the transmission and reception of various pieces of data to and from an external device such as a personal computer connected via the network.

The storage unit 140 is a storage device such as a HDD (Hard Disk Drive). Image data transmitted from the external device is stored in the storage unit 140 by the network IF unit 130. Further, relationship information is stored in advance in the storage unit 140. The relationship information is information representing a relationship between an electrical characteristic of discharge products adhering to the surface of the photoconductive drum 3 and a proper inter-peak voltage value. The proper inter-peak voltage value is an inter-peak voltage value of the alternating-current voltage Vac included in the charging voltage Vcg capable of properly charging the surface of the photoconductive drum 3. The relationship information is described in detail later.

The control unit 10 controls the operation of the entire printer 1. The control unit 10 is, for example, constituted by a microprocessor including a CPU (Central Processing Unit) for performing a predetermined arithmetic processing, a nonvolatile memory such as an EEPROM (Electrically Erasable and Programmable Read Only Memory) storing a predetermined control program, a RAM (Random Access Memory) for temporarily storing data, peripheral circuits of these and the like.

The control unit 10 operates as a print controller 11, a process executor 12, a characteristic deriver 13 and a voltage setter 14 as indicated by solid-line rectangles of FIG. 4 by executing the control program stored in the above memory or the like.

The print controller 11 performs a printing process of forming images on sheets. Specifically, in the printing process, the print controller 11 causes the exposure device 5 to form electrostatic latent images on the circumferential surface of the photoconductive drum 3 after the circumferential surface of the photoconductive drum 3 is charged by the charging device 4. After causing the developing device 6 to develop the electrostatic latent images formed on the circumferential surface of the photoconductive drum 3 as toner images, the print controller 11 causes the transfer device 7 to transfer the toner images to sheets. The print controller 11 causes the fixing unit 20 to fix the transferred toner images to the sheets. In this way, the images are formed on the sheets.

Further, the print controller 11 causes the sheet feeding unit 90 to discharge the sheet having the image formed thereon by the printing process. Further, the print controller 11 causes the toner remaining on the photoconductive drum 3 to be removed by rotating the cleaning roller 81 at a rotation speed faster than the photoconductive drum 3 during the execution of the printing process.

The process executor 12 executes a refresh process at a predetermined timing. The refresh process is a process of rubbing the surface of the photoconductive drum 3 against the cleaning roller 81 for a predetermined time (e.g. 60 sec) by supplying a predetermined amount of the toner to the cleaning roller 81 while rotating the cleaning roller 81 at a rotation speed (e.g. 266×1.2 mm/sec) faster than a rotation speed (e.g. 266 mm/sec) of the photoconductive drum 3.

In the refresh process, the amount of the toner supplied to the cleaning roller 81 is, for example, determined as the amount of the toner supplied when a toner image is formed in an area of 94 mm in a rotating direction of the surface of the photoconductive drum 3. Note that this toner amount may be appropriately adjusted according to the temperature and humidity indicated by the detection signal output by the environment sensor 98.

An execution timing of the refresh process by the process executor 12 is, for example, determined as a timing when the printer 1 is turned on or returns from a sleep state when the humidity indicated by the detection signal output by the environment sensor 98 (hereinafter, detected humidity) is within a predetermined high humidity range (e.g. 60% or higher and below 70%).

Note that the high humidity range may be classified into a plurality of ranges such as a range of 60% or higher and below 70%, a range of 70% or higher and below 80% and a range of 80% or higher. Further, for each classified range, the number of times of execution of the refresh process may be determined to be larger as the humidity indicated by the range becomes higher. For example, it may be determined that the refresh process is executed twice if the detected humidity is in the high humidity range of 60% or higher and below 70% and four times if the detected humidity is in the high humidity range of 70% or higher and below 80%. Furthermore, similarly to this, it may be determined for each classified range, a larger amount of the toner is supplied to the cleaning roller 81 in the refresh process as the humidity indicated by this range becomes higher.

The characteristic deriver 13 derives an electrical characteristic of discharge products such as nitrate ions and ammonium ions adhering to the surface of the photoconductive drum 3 by discharge from the charging roller 41 on the basis of the charging voltage Vcg applied to the charging roller 41 by the voltage applier 45 and the current value of the charging current Idc detected by the current detector 44.

Figure 5:
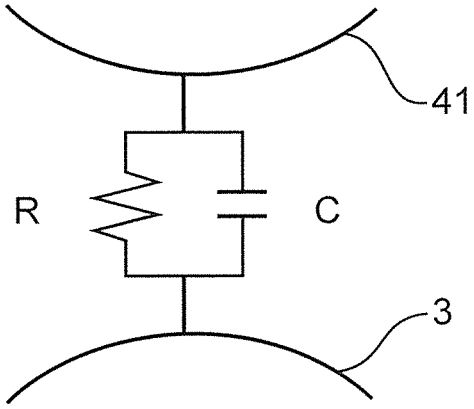
FIG. 5 is an equivalent circuit diagram of discharge products adhering to a surface of a photoconductive drum.
Figure 6:
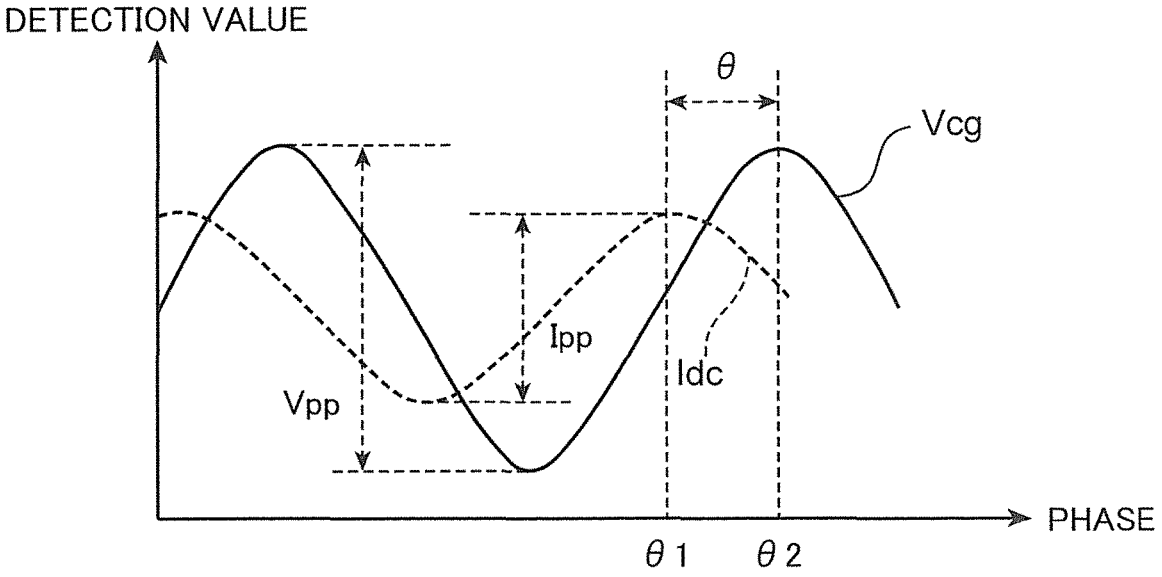
FIG. 6 is a graph showing the waveforms of a charging voltage and a charging current.

FIG. 5 is an equivalent circuit diagram of discharge products adhering to the surface of the photoconductive drum 3. FIG. 6 is a graph showing the waveforms of the charging voltage Vcg and the charging current Idc. Specifically, the characteristic deriver 13 regards the adhesion of the discharge products to the surface of the photoconductive drum 3 as the insertion of a parallel circuit composed of a resistor having a resistance value R and a condenser or capacitor having a capacitance C between the surface of the photoconductive drum 3 and the charging roller 41 as shown in FIG. 5.

The characteristic deriver 13 causes the direct-current voltage applier 42 to output a direct-current voltage Vdc having a predetermined direct-current voltage value and causes the alternating-current voltage applier 43 to output an alternating-current voltage Vac having a predetermined inter-peak voltage value Vpp. In this way, the characteristic deriver 13 causes the voltage applier 45 to apply a charging voltage Vcg obtained by superimposing the direct-current voltage Vdc and the alternating-current voltage Vac to the charging roller 41. Note that the predetermined direct-current voltage value and the predetermined inter-peak voltage value Vpp are, for example, determined to be voltage values of several tens of V to prevent discharge from the charging roller 41 when the charging voltage Vcg obtained by superimposing the direct-current voltage Vdc having the direct-current voltage value and the alternating-current voltage Vac having the inter-peak voltage value Vpp is applied to the charging roller 41.

The characteristic deriver 13 derives an impedance Z of the parallel circuit as the electrical characteristic of the discharge products adhering to the surface of the photoconductive drum 3 as shown in FIG. 6, using the following equation (1) including the inter-peak voltage value Vpp of the alternating-current voltage Vac included in the charging voltage Vcg and an inter-peak current value Ipp of the charging current Idc detected by the current detector 44. Note that the characteristic deriver 13 may be constituted by ASIC (Application Specific Integrated Circuits).

[Equation 1]

$$Z = \frac{|Vpp|}{|Ipp|} \tag{1}$$

The voltage setter 14 causes the characteristic deriver 13 to derive the electrical characteristic of the discharge products at a predetermined timing. Then, the voltage setter 14 obtains a proper inter-peak voltage value corresponding to the electrical characteristic of the discharge products derived by the characteristic deriver 13 in the relationship information stored in advance in the storage unit 140. Then, the voltage setter 14 sets the obtained proper inter-peak voltage value as the inter-peak voltage value of the alternating-current voltage Vac to be output by the alternating-current voltage applier 43 during the execution of the printing process by the print controller 11.

A timing of the voltage setter 14 to set the inter-peak voltage value of the alternating-current voltage Vac as described above is determined to be, for example, a timing when the printer 1 is turned on or returns from a sleep state. Note that if the setting timing of the voltage setter 14 overlaps the execution timing of the refresh process by the process executor 12, the voltage setter 14 prioritizes the execution of the refresh process and sets the inter-peak voltage value at a timing after the completion of the refresh process in this case.

Figure 7:
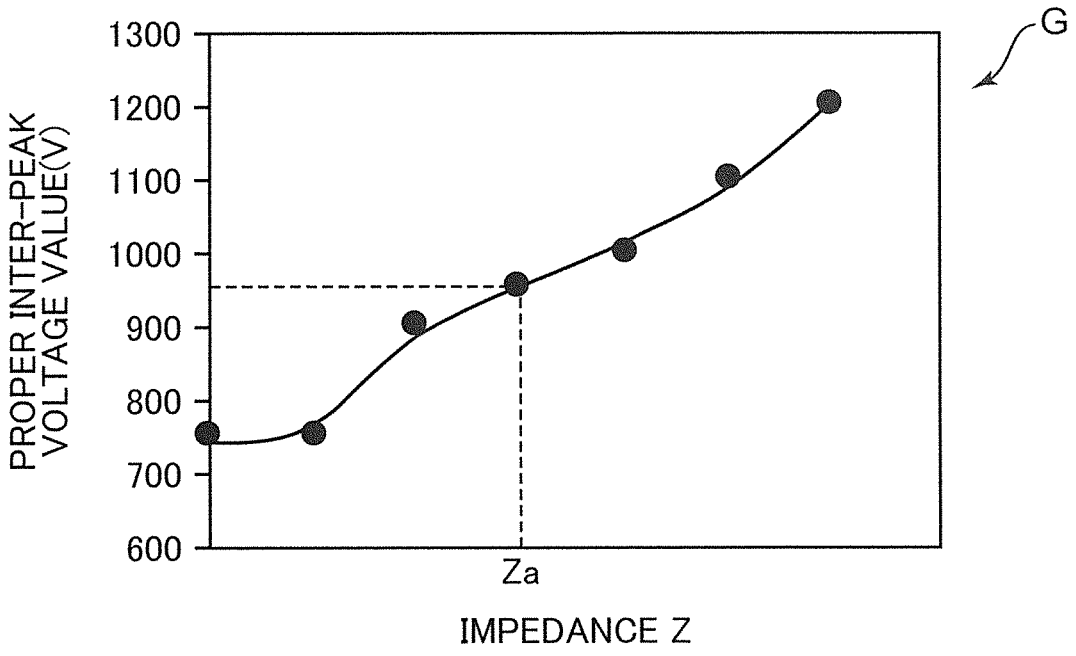
FIG. 7 is a graph showing an example of relationship information.

FIG. 7 is a graph showing an example of relationship information G Specifically, as shown in FIG. 7, the relationship information G representing a relationship between the impedance Z of the discharge products as the electrical characteristic of the discharge products and a proper inter-peak voltage value V0, which is the inter-peak voltage value of the alternating-current voltage Vac capable of properly charging the surface of the photoconductive drum 3 having the discharge products having the impedance Z adhering thereto, is stored in the storage unit 140.

Black circles of FIG. 7 represent a relationship, obtained by an experiment conducted in advance, between the impedance Z of the discharge products and the proper inter-peak voltage value V0 capable of properly charging the surface of the photoconductive drum 3 having the discharge products having the impedance Z adhering thereto. A curve of FIG. 7 is an approximation curve representing the relationship of the impedance Z of the discharge products and the proper inter-peak voltage value V0 and derived on the basis of the relationship represented by the black circles of FIG. 7. Information representing this approximation curve is equivalent to the relationship information G.

For example, in the relationship information G shown in FIG. 7, "950 V" is determined as the proper inter-peak voltage value V0 capable of properly charging the surface when discharge products whose impedance Z is "Za" adhere to the surface of the photoconductive drum 3. In other words, in the relationship information G shown in FIG. 7, "Za" as the impedance Z of the discharge products and "950 V" as the proper inter-peak voltage value V0 are associated.

The voltage setter 14 refers to the relationship information G stored in the storage unit 140 and obtains the proper inter-peak voltage value V0 (e.g. "950 V") corresponding to the impedance Z (e.g. Za) of the discharge products derived by the characteristic deriver 13 in the relationship information G. Then, the voltage setter 14 sets the obtained proper inter-peak voltage value V0 as the inter-peak voltage value of the alternating-current voltage Vac to be output by the alternating-current voltage applier 43 during the execution of the printing process by the print controller 11.

That is, according to the configuration of the first embodiment, the impedance Z of the discharge products is derived as the electrical characteristic of the discharge products adhering to the surface of the photoconductive drum 3 on the basis of the charging voltage Vcg applied to the charging roller 41 by the voltage applier 45 and the current value of the charging current Idc detected by the current detector 44. In this way, the amount of the adhering discharge products corresponding to a degree of wear deterioration of the photoconductive drum 3 can be grasped as the impedance Z of the discharge products.

Further, according to the configuration of the first embodiment, the proper inter-peak voltage value V0 corresponding to the derived impedance Z in the relationship information G stored in advance in the storage unit 140 is set as the inter-peak voltage value of the alternating-current voltage Vac to be applied to the charging roller 41. In this way, the above setting can be quickly made without detecting the current value of the charging current Idc flowing from the charging roller 41 to the photoconductive drum 3 a plurality of number of times by switching the inter-peak voltage value of the alternating-current voltage Vac to be applied to the charging roller 41 a plurality of number of times.

Accordingly, according to the configuration of the first embodiment, the alternating-current voltage Vac having the proper inter-peak voltage value V0 capable of properly charging the surface of the photoconductive drum 3 having the amount of discharge products grasped from the derived impedance Z adhering thereto and corresponding to the impedance Z in the relationship information G can be quickly applied to the charging roller 41 by the voltage applier 45. As a result, the surface can be quickly and properly charged.

Second Embodiment

Next, an image forming apparatus according to a second embodiment of the present disclosure is described. Note that, in the following description, the same constituent elements as in the first embodiment are denoted by the same reference signs as in the first embodiment and are not described. The second embodiment differs from the first embodiment in that a control unit 10 operates further as a phase difference detector 15 by executing the control program stored in the above memory as indicated by a broken line rectangle of FIG. 4.

The phase difference detector 15 detects a phase difference between a charging voltage Vcg applied to a charging roller 41 by a voltage applier 45 and a charging current Idc flowing from the charging roller 41 to a photoconductive drum 3. Specifically, as shown in FIG. 6, the phase difference detector 15 detects a phase difference θ between a phase θ1 when a current value of the charging current Idc flowing from the charging roller 41 to the photoconductive drum 3 and detected by a current detector 44 is largest (peak value) and a phase θ2 when a voltage value of the charging voltage Vcg applied to the charging roller 41 by the voltage applier 45 is largest (peak value). Note that the phase difference detector 15 may be constituted by ASIC (Application Specific Integrated Circuits).

Further, the second embodiment differs from the first embodiment in that a characteristic deriver 13 derives a resistance value of discharge products as an electrical characteristic of the discharge products on the basis of the phase difference θ detected by the phase difference detector 15.

Specifically, the characteristic deriver 13 regards the adhesion of the discharge products to the surface of the photoconductive drum 3 as the insertion of a parallel circuit composed of a resistor having a resistance value R and a condenser or capacitor having a capacitance C between the surface of the photoconductive drum 3 and the charging roller 41 as shown in FIG. 5 as in the first embodiment. The characteristic deriver 13 causes the voltage applier 45 to apply a charging voltage Vcg obtained by superimposing a direct-current voltage Vdc having a predetermined direct-current voltage value and an alternating-current voltage Vac having a predetermined inter-peak voltage value Vpp to the charging roller 41 as in the first embodiment. Then, the characteristic deriver 13 derives an impedance Z of the parallel circuit, using the above equation (1) using the inter-peak voltage value Vpp of the alternating-current voltage Vac included in the charging voltage Vcg and an inter-peak current value Ipp of the charging current Idc detected by the current detector 44.

In the second embodiment, the characteristic deriver 13 further derives the resistance value R of the resistor of the parallel circuit as an electrical characteristic of the discharge products adhering to the surface of the photoconductive drum 3, using the following three known relational equations (2) to (4) concerning an RC parallel circuit using the calculated impedance Z of the parallel circuit and the phase difference θ detected by the phase difference detector 15. Note that, in the equations (2) to (4), ω denotes an angular frequency (=2π×frequency) of the alternating-current voltage Vac included in the charging voltage Vcg, and j denotes an imaginary unit.

[Equation 2]

$$Z = \frac{R}{1 + j\omega RC} \tag{2}$$

$$Z\cos\theta = \frac{R}{1 + j\omega^2 R^2 C^2} \tag{3}$$

$$Z\sin\theta = \frac{\omega R^2 C}{1 + j\omega^2 R^2 C^2} \tag{4}$$

In accordance with this, a relationship information G representing a relationship between the resistance value R of the discharge products and a proper inter-peak voltage value V0 capable of properly charging the surface of the photoconductive drum 3 having the discharge products having the resistance value R adhering thereto, similar to the relationship information G shown in FIG. 7, is stored in advance in a storage unit 140.

A voltage setter 14 refers to the relationship information G stored in the storage unit 140 and obtains the proper inter-peak voltage value V0 corresponding to the resistance value R of the discharge products derived by the characteristic deriver 13 in the relationship information G as in the first embodiment. Then, the voltage setter 14 sets the obtained proper inter-peak voltage value V0 as the inter-peak voltage value Vpp of the alternating-current voltage Vac to be output by an alternating-current voltage applier 43 during the execution of a printing process by a print controller 11.

That is, according to the configuration of the second embodiment, the resistance value R of the discharge products adhering to the surface of the photoconductive drum 3 is derived on the basis of the charging voltage Vcg applied to the charging roller 41 by the voltage applier 45, the current value of the charging current Idc detected by the current detector 44 and the phase difference θ detected by the phase difference detector 15. In this way, the alternating-current voltage Vac having the proper inter-peak voltage value V0 capable of properly charging the surface of the photoconductive drum 3 having the amount of discharge products grasped from the derived resistance value R of the discharge products adhering thereto and corresponding to the resistance value R in the relationship information G can be quickly applied to the charging roller 41 by the voltage applier 45. As a result, the surface can be quickly and properly charged.

Third Embodiment

Next, an image forming apparatus according to a third embodiment of the present disclosure is described. Note that, in the following description, the same constituent elements as in the second embodiment are denoted by the same reference signs as in the second embodiment and are not described. The third embodiment differs from the second embodiment in that a characteristic deriver 13 derives a capacitance of discharge products as an electrical characteristic of the discharge products.

Specifically, the characteristic deriver 13 causes a voltage applier 45 to apply a charging voltage Vcg obtained by superimposing a direct-current voltage Vdc having a predetermined direct-current voltage value and an alternating-current voltage Vac having a predetermined inter-peak voltage value Vpp to a charging roller 41 as in the second embodiment. Then, the characteristic deriver 13 calculates an impedance Z of the above parallel circuit (FIG. 5), using the above equation (1) including the inter-peak voltage value Vpp of the alternating-current voltage Vac included in the charging voltage Vcg and an inter-peak current value Ipp of the charging current Idc detected by a current detector 44. Further, the characteristic deriver 13 derives a capacitance C of the condenser or capacitor of the parallel circuit (FIG. 5) as a capacitance C of discharge products adhering to a surface of a photoconductive drum 3, using the aforementioned three known relational equations (2) to (4) concerning an RC parallel circuit including the calculated impedance Z of the parallel circuit and a phase difference θ detected by a phase difference detector 15.

In accordance with this, a relationship information G representing a relationship between the capacitance C of the discharge products and a proper inter-peak voltage value V0 capable of properly charging the surface of the photoconductive drum 3 having the discharge products having the capacitance C adhering thereto, similar to the relationship information G shown in FIG. 7, is stored in advance in a storage unit 140.

The voltage setter 14 refers to the relationship information G stored in the storage unit 140 and obtains the proper inter-peak voltage value V0 corresponding to the capacitance C of the discharge products derived by the characteristic deriver 13 in the relationship information G as in the second embodiment. Then, the voltage setter 14 sets the obtained proper inter-peak voltage value V0 as the inter-peak voltage value Vpp of the alternating-current voltage Vac to be output by an alternating-current voltage applier 43 during the execution of a printing process by a print controller 11.

That is, according to the configuration of the third embodiment, the capacitance C of the discharge products adhering to the surface of the photoconductive drum 3 is derived on the basis of the charging voltage Vcg applied to the charging roller 41 by the voltage applier 45, the current value of the charging current Idc detected by the current detector 44 and a phase difference θ detected by the phase difference detector 15. In this way, the alternating-current voltage Vac having the proper inter-peak voltage value V0 capable of properly charging the surface of the photoconductive drum 3 having the amount of discharge products grasped from the derived capacitance C of the discharge products adhering thereto and corresponding to the capacitance C in the relationship information G can be quickly applied to the charging roller 41 by the voltage applier 45. As a result, the surface can be quickly and properly charged.

Note that the above first to third embodiments are mere illustration of the embodiment according to the present disclosure and not intended to limit the present disclosure to the above embodiments. For example, the present disclosure may be modified as follows.

(1) The relationship information G may be classified for each combination of a usage status of the photoconductive drum 3 and the air environment around the photoconductive drum 3. The usage statuses of the photoconductive drum 3 include, for example, a cumulative usage time and a cumulative use frequency of the photoconductive drum 3 by the printing process. The air environment around the photoconductive drum 3 includes, for example, the temperature and humidity detected by the environment sensor 98.

FIG. 8 is a table showing an example of the relationship information G stored in the storage unit 140. Specifically, as shown in FIG. 8, the storage unit 140 may store the relationship information G corresponding to the combination of the usage status and the air environment in association with the usage status of the photoconductive drum 3 and the air environment around the photoconductive drum 3. For example, FIG. 8 shows an example in which the relationship information G corresponding to a case where the cumulative usage time of the photoconductive drum 3 as the usage status of the photoconductive drum 3 is "C1" or more and less than "C2", a temperature T around the photoconductive drum 3 is "T1" or higher and lower than "T2" and a humidity H around the photoconductive drum 3 is "H1" or higher and lower than "H2", i.e. "relationship information G11" is stored in the storage unit 140.

In accordance with this, the control unit 10 may execute the control program stored in the above memory or the like to further operate as a usage status administrator 16 for administering the usage status of the photoconductive drum 3 as indicated by a dashed-dotted line rectangle of FIG. 4.

Specifically, the status administrator 16 administers the usage status of the photoconductive drum 3 by cumulatively adding an execution time of the printing process by the print controller 11 and storing the cumulative addition result as the cumulative usage time of the photoconductive drum 3 in the storage unit 140. Alternatively, the status administrator 16 administers the usage status of the photoconductive drum 3 by cumulatively adding the number of sheets having images formed thereon by the printing process and storing the cumulative addition result as the cumulative usage frequency of the photoconductive drum 3 in the storage unit 140.

Further, the voltage setter 14 may set the proper inter-peak voltage value V0 corresponding to the electrical characteristic derived by the characteristic deriver 13 in the relationship information G corresponding to the combination of the usage status of the photoconductive drum 3 and the air environment detected by the environment sensor 98 administered by the status administrator 16 as the inter-peak voltage value of the alternating-current voltage Vac.

For example, it is assumed that the relationship information G is stored in the storage unit 140 as shown in FIG. 8. Further, it is assumed that the usage status of the photoconductive drum 3 is "C1" or more and less than "C2" shown in FIG. 8, the temperature T around the photoconductive drum 3 detected by the environment sensor 98 is "T1" or higher and lower than "T2" shown in FIG. 8 and the humidity H around the photoconductive drum 3 detected by the environment sensor 98 is "H1" or higher and lower than "H2" shown in FIG. 8. In this case, the voltage setter 14 may set the proper inter-peak voltage value V0 corresponding to the electrical characteristic derived by the characteristic deriver 13 in the relationship information G corresponding to the combination of the usage status of the photoconductive drum 3 and the air environment detected by the environment sensor 98, i.e. "relationship information G11" as the inter-peak voltage value of the alternating-current voltage Vac.

According to the configuration of this modification, the alternating-current voltage Vac having the proper inter-peak voltage value V0 corresponding to the electrical characteristic derived by the characteristic deriver 13 in the relationship information G corresponding to the combination of the usage status of the photoconductive drum 3 and the air environment around the photoconductive drum 3 detected by the environment sensor 98 administered by the status administrator 16 can be quickly applied to the charging roller 41 by the voltage applier 45. Thus, the surface of the photoconductive drum 3 can be quickly and properly charged according to the usage status of the photoconductive drum 3 and the air environment around the photoconductive drum 3.

Note that the relationship information G may be classified for each air environment around the photoconductive drum 3 without being classified for each usage status of the photoconductive drum 3. That is, the storage unit 140 may store the relationship information G corresponding to the air environment in association with the air environment around the photoconductive drum 3. In accordance with this, the control unit 10 may not operate as the status administrator 16. Then, the voltage setter 14 may set the proper inter-peak voltage value V0 corresponding to the electrical characteristic derived by the characteristic deriver 13 in the relationship information G corresponding to the air environment detected by the environment sensor 98 as the inter-peak voltage value of the alternating-current voltage Vac.

Alternatively, the relationship information G may be classified for each usage status of the photoconductive drum 3 and may not be classified for each air environment around the photoconductive drum 3. That is, the storage unit 140 may store the relationship information G corresponding to the usage status in association with the usage status of the photoconductive drum 3. In accordance with this, the voltage setter 14 may set the proper inter-peak voltage value V0 corresponding to the electrical characteristic derived by the characteristic deriver 13 in the relationship information G corresponding to the usage status of the photoconductive drum 3 administered by the status administrator 16 as the inter-peak voltage value of the alternating-current voltage Vac.

(2) The control unit 10 may not operate as the process executor 12.

(3) In the above first to third embodiments and the above modifications, the image forming apparatus according to the one embodiment of the present disclosure is an image forming apparatus of a monochrome printing type for forming images on sheets using one image forming unit 2. However, without limitation to this, the image forming apparatus according to the present disclosure may be an image forming apparatus of a color printing type for forming multicolor images on sheets by including a plurality of image forming units similar to the image forming unit 2. In this case, the process executor 12, the characteristic deriver 13, the voltage setter 14, the phase difference detector 15 and the status administrator 16 may operate as described in the above first to third embodiments and the above modifications for each of the plurality of image forming units.

According to the present disclosure as described above, a surface of a photoconductor can be quickly and properly charged.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

a photoconductor including a photoconductive layer forming a surface for carrying an electrostatic latent image;

a charging member arranged in contact with or in proximity to the surface;

a voltage applier for charging the surface by applying an oscillating voltage obtained by superimposing a direct-current voltage and an alternating-current voltage to the charging member;

a storage unit for storing in advance relationship information representing a relationship between an electrical characteristic of discharge products adhering to the surface and a proper inter-peak voltage value which is an inter-peak voltage value of the alternating-current voltage capable of properly charging the surface;

a current detector for detecting a current value of a current flowing from the charging member to the photoconductor;

a characteristic deriver for deriving the electrical characteristic of the discharge products adhering to the surface on the basis of the oscillating voltage applied to the charging member by the voltage applier and the current value; and a voltage setter for setting the proper inter-peak voltage value corresponding to the electrical characteristic derived by the characteristic deriver in the relationship information as the inter-peak voltage value of the alternating-current voltage.

2. An image forming apparatus according to claim 1, further comprising:

an environment detector for detecting an air environment around the photoconductor, wherein:

the relationship information is classified for each air environment of the photoconductor; and the voltage setter sets the proper inter-peak voltage value corresponding to the electrical characteristic derived by the characteristic deriver in the relationship information corresponding to the air environment detected by the environment detector as the inter-peak voltage value of the alternating-current voltage.

3. An image forming apparatus according to claim 1, further comprising:

a status administrator for administering a usage status of the photoconductor, wherein:

the relationship information is classified for each usage status of the photoconductor; and the voltage setter sets the proper inter-peak voltage value corresponding to the electrical characteristic derived by the characteristic deriver in the relationship information corresponding to the usage status administered by the status administrator as the inter-peak voltage value of the alternating-current voltage.

4. An image forming apparatus according to claim 1, wherein:

the electrical characteristic is an impedance.

5. An image forming apparatus according to claim 1, further comprising:

a phase difference detector for detecting a phase difference between the oscillating voltage and the current, wherein:

the characteristic deriver further derives a resistance value of the discharge products as the electrical characteristic on the basis of the phase difference.

6. An image forming apparatus according to claim 1, further comprising:

a phase difference detector for detecting a phase difference between the oscillating voltage and the current, wherein:

the characteristic deriver further derives a capacitance of the discharge products as the electrical characteristic on the basis of the phase difference.

7. An image forming apparatus according to claim 1, wherein:

the photoconductive layer is made of amorphous silicon.

* * * * *